United States Patent [19]

Ichikawa

[11] Patent Number: 4,718,778

[45] Date of Patent: Jan. 12, 1988

[54] LIQUID CONTAINER

[75] Inventor: Tooru Ichikawa, Misato, Japan

[73] Assignee: Kabushiki Kaisha Hosokawa Yoko, Tokyo, Japan

[21] Appl. No.: 826,388

[22] Filed: Feb. 5, 1986

[30] Foreign Application Priority Data

Feb. 14, 1985 [JP] Japan ..... 60-19574

[51] Int. Cl.[4] ..... B65D 33/01

[52] U.S. Cl. ..... 383/100; 383/906; 229/75; 222/211; 222/212; 220/90.4; 239/33

[58] Field of Search ..... 383/100, 906; 206/217; 220/366, 367, 90.4; 222/544, 92, 211, 212, 464, 481, 482, 485, 529, 531, 547, 562, 478; 229/75; 215/1 A, 4; 239/33

[56] References Cited

U.S. PATENT DOCUMENTS

| | | | |
|---|---|---|---|
| 3,241,726 | 3/1966 | Chester | 222/212 |
| 3,355,072 | 11/1967 | Sheppard et al. | 222/212 |
| 3,966,099 | 6/1976 | Sanford, Jr. et al. | 222/478 |
| 4,091,966 | 5/1978 | Laauwe | 222/211 |
| 4,159,790 | 7/1979 | Bailey | 222/212 |
| 4,291,814 | 9/1981 | Conn | 229/7 S |
| 4,394,936 | 7/1983 | Shavit | 222/92 |
| 4,407,435 | 10/1983 | Harmon | 222/481 |
| 4,596,341 | 6/1986 | Bruffey | 220/90.4 |

*Primary Examiner*—Willis Little

*Attorney, Agent, or Firm*—Wenderoth, Lind & Ponack

[57] ABSTRACT

A liquid container is made of a flexible film and a delivery device is securely attached to the container in such a way that a conduit portion of the delivery device extends into the interior of the liquid container. An opening is formed in the cylindrical wall of the conduit portion adjacent to the sealed top of the container. When the delivery device is used as a straw, the opening is closed with the wall of the container because of its flexibility. When the content in the container is poured into another liquid receptacle, the opening is used as an inlet so that the content of the container can be completely emptied.

5 Claims, 4 Drawing Figures

LIQUID CONTAINER

BACKGROUND OF THE INVENTION

The present invention relates to a liquid container which is filled with orange juice or "sport" drink, for example.

It has been well known in the art that there are various types of liquid containers which are filled, with, orange juice, for instance. One of them is an upwardly open bag-shaped container made of a flexible film. After a liquid is poured into such a bag-shaped container, its open top is thermally sealed. There is provided an opening for a straw in the upper wall of the bag-shaped container main body. The opening is normally closed with a seal. In order to drink a liquid in the bag-shaped container, first one must remove the seal from the container and break a seal film at the opening so as to insert the straw into the inside of the liquid container.

That is, in the case of the liquid container of the type described above, a straw must be further provided. Therefore, if a straw is not available, one cannot drink the content in the container. As a result, one must try to open the sealed top of the liquid container by hand when a knife or the like is not available.

In order to overcome the above and other problems encountered in the prior art bag-shaped liquid containers of the type described, there has been devised and demonstrated a liquid container comprising an upwardly open bag-shaped main body made of a flexible film and a delivery device which has a mouth portion and a conduit portion and is securely attached to the top opening of the bag-shaped main body in such a way that the conduit portion extends into the interior of the bag-shaped main body.

The liquid container of the type just described above is light in weight and can be easily opened as compared with other liquid containers such as cans, bottles or the like so that it is used not only for storing drinks but also for containing various sauces for noodles, meats and the like.

The liquid container of the type just described above can overcome the above described problems, but since a liquid is poured through the open top of the delivery device when the liquid is filled into the container, air is apt to remain in the upper portion of the liquid container. As a result, the volume of a liquid poured into the liquid container is decreased.

Furthermore, when the content in the liquid container is poured into another liquid receptacle such as a cup through the delivery device, part of the content filled in the liquid container still remains therein because the conduit portion of the delivery device extends into the interior of the liquid container, that is, a sucking opening is placed in a position near the bottom of the container. Thus there arises the problem that the content in the liquid container cannot be completely emptied, which is not economical.

SUMMARY OF THE INVENTION

It is an object of the present invention to provide a liquid container of the type in which when the container is filled with a liquid, the air which remains in the container is forced out of the container so that the volume of the content filled in the liquid container can be increased and in which when the content in the liquid container is sucked or poured out, it can be completely emptied.

According to this invention, there is provided a liquid container comprising a sealed bag-shaped main body made of a flexible film and a delivery device for passing the content of the main body therethrough which comprises a mouth portion and a conduit portion and which is attached to the sealed top of the bag-shaped main body in such a way that the conduit portion of the delivery device extends into the interior of the liquid container, the delivery device being provided with at least one opening in the cylindrical wall of the conduit portion of the delivery device adjacent to the top of the bag-shaped main body which is sealed so that when the delivery device is used as a straw, the opening is closed with the wall of the bag-shaped main body because of its flexibility while the content is poured into another liquid receptacle such as a cup, the opening is used as an inlet for the content.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
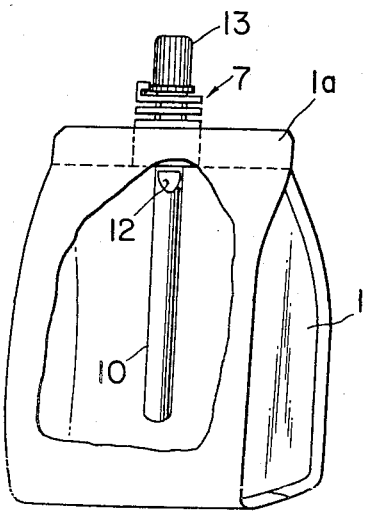
FIG. 1 is a perspective view, with a part broken away, of a liquid container according to the present invention.
Figure 2:
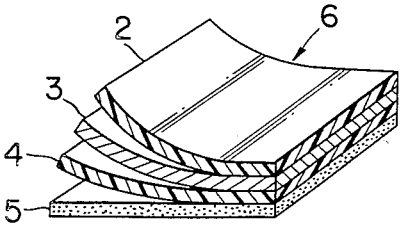
FIG. 2 shows a part of a flexible film used to make a bag-shaped main body of the liquid container shown in FIG. 1.

Referring first to FIG. 1, reference numeral 1 designates the main body of a bag-shaped container with a sealed top 1*a*. The main body 1 is made of a laminated film 6 consisting of, as shown in FIG. 2, a polyester film (12$\mu$ in thickness) 2, aluminum foil (9$\mu$ in thickness) 3, elongated nylon film (15$\mu$ in thickness) 4 and polyethylene film (60–120$\mu$ in thickness) 5 and has a flexible structure. A content delivery device 7 is securely attached to the sealed top 1*a* of the main body 1 and is securely joined integral with the main body 1.

Figure 3:
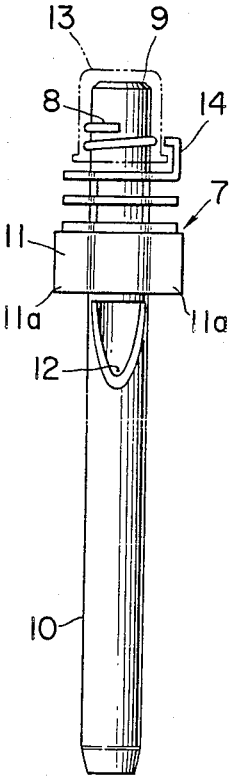
FIG. 3 is a side view of a delivery device of the present invention.

The content delivery device 7 for passing the content of the container therethrough has a mouth portion 9 with a screw thread 8 and a conduit portion 10 which is formed integral with the mouth portion 9 and extends downwardly as shown in FIG. 3. The mouth portion 9 is located outside of the main body 1. An opening 12 is formed in the cylindrical wall of the conduit portion 10 adjacent to a joint portion 11 formed at the upper end portion of the conduit poriton 10. The length of the conduit portion 10 is selected such that when the delivery device 7 is securely attached to the sealed top 1*a* of the main body 1, the lower end of the conduit portion 10 is located adjacent to the bottom of the bag-shaped main body 1. The joint portion 11 has a pair of flanges 11*a*, 11*a* formed on a diametric line of the delivery device. The opening 12 is formed in a position opposed to the side walls of the main body 1 when the flanges 11*a*, 11*a* are held between the two pieces of the sealed top 1*a*.

In FIG. 1, reference numeral 13 designates a cap screwed onto the mouth portion 9. The lower end of the cap 13 is held by a cap holding member 14 formed near the mouth portion 9.

Next the mode of operation will be described.

When the content delivery device 7 is used as a straw, the cap 13 is removed from the mouth portion 9 and one keeps the mouth portion 9 in one's mouth and sucks. Then, due to the flexibility of the bag-shaped main body 1, the wall of the bag-shaped main body 1 is pulled toward the opening 12 of the conduit portion 10. Therefore, the opening 12 is closed with the wall of the main body 1 so that the content is sucked from the lower end of the conduit poriton 10.

When the content delivery device 7 is used as a pouring means, one holds the bag-shaped main body 1 with a hand and inclines the same in such a manner that the content can be discharged through the opening 12. Then the opening 12 of the conduit portion 10 acts as an inlet so that the content filled in the bag-shaped main body 1 is completely emptied.

Figure 4:
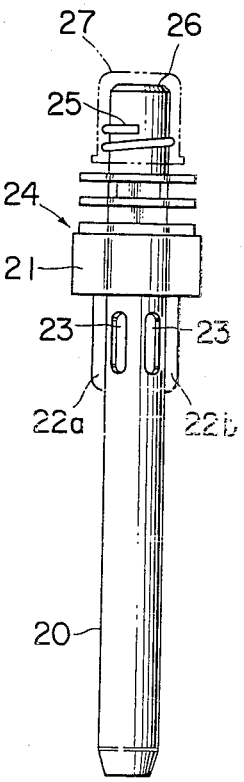
FIG. 4 is a side view of another embodiment of a delivery device of the present invention.

FIG. 4 is a side view of a second embodiment of a content delivery device in accordance with the present invention. In the second embodiment, a pair of ribs 22*a* and 22*b* extend downwardly from the lower end of a joint portion 21 formed at the upper end portion of a conduit portion 20 parallel with the axis of the conduit portion 20. The two ribs 22*a* and 22*b* are formed on a diametric line of the conduit 20, respectively. A plurality of slit-like openings (four openings in FIG. 4) 23 are formed in the cylindrical wall of the conduit portion 20 between the pair of ribs 22*a* and 22*b*. The ribs 22*a* and 22*b* are formed for reinforcing the slit-opening forming portion of the conduit portion 20.

A cap 27 is screwed onto a mouth portion 26 with a screw thread 25 of the content delivery device 24.

Since a plurality of slit-shaped openings 23 are formed, when the delivery device 24 is used as a straw, the slit-shaped openings 23 can be positively and easily closed with the walls of the bag-shaped main body 1. When the delivery device 24 is used as a pouring means, the content in the bag-shaped main body 1 can be completely emptied.

What is claimed is:

1. A liquid container comprising:

a bag-shaped main body comprising a flexible film and having a sealed top; and a delivery device secured to said sealed top for allowing contents contained in the main body to pass therethrough, said delivery device comprising a mouth portion extending outside of the main body through which the contents contained in the main body can be sucked and discharged from the main body, a conduit portion extending from said mouth portion within the bag-shaped main body and through which the contents pass to the mouth portion, and a pair of ribs extending parallel to one another along said conduit member from a location adjacent the sealed top of the main body, said conduit portion having at least one opening extending radially therethrough between said pair of ribs.

2. A liquid container as claimed in claim 1, wherein said ribs are diametrically opposed from one another on the conduit portion and extend therealong in a direction that is parallel to a central longitudinal axis of the conduit portion.

3. A container as claimed in claim 1, wherein said at least one opening has a slit-like shape.

4. A container as claimed in claim 3, wherein a semi-circular wall of the conduit portion extends between said pair of ribs and said at least one opening comprises two openings extending through said semi-circular wall.

5. A liquid container for containing contents which facilitates both the sucking of the contents therefrom and the pouring of substantially all of the contents therefrom when the container is inverted from a normal upright position, the liquid container comprising:

a bag-shaped main body comprised of a flexible film and having a sealed top, the sealed top being at the top of the main body when the container is at said upright position; and a delivery device secured to the sealed top for allowing the contents contained in the main body to be sucked therefrom and for allowing the contents contained in the main body to be substantially completely poured therefrom when the container is inverted from said upright position, said delivery device comprising a mouth portion extending outside of the main body and substantially upward therefrom when the container is in said upright position, a conduit portion extending from the mouth portion into the main body and through which the contents contained in the main body pass to the mouth portion, the conduit portion having an axial opening extending therein open at one end thereof that is open to the mouth portion and through which the contents contained in the main body pass to the mouth portion when suction is applied to the mouth portion by the mouth of a person, and the conduit portion only having a second opening means extending radially therethrough adjacent the sealed top of the main body that is open to and communicates with said axial opening for allowing the contents contained in the main body to pass to the mouth portion and substantially completely discharge from the main body when the container is inverted from said upright portion, the second opening means being covered by the bag-shaped main body comprising a flexible film when the suction is applied to the mouth portion and the main body having the sealed top thereby collapses inward and over the second opening means to facilitate the passing of the contents through the axial opening of the conduit portion from the open end thereof to the mouth portion.

* * * * *